US010369793B2

(12) United States Patent
Mourey et al.

(10) Patent No.: US 10,369,793 B2
(45) Date of Patent: Aug. 6, 2019

(54) SERVICE STRUCTURES IN PRINT HEADS

(71) Applicant: HEWLETT-PACKARD DEVELOPMENT COMPANY, L.P., Houston, TX (US)

(72) Inventors: Devin Alexander Mourey, Albany, OR (US); Chien-Hua Chen, Corvallis, OR (US); Michael W. Cumbie, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/747,619

(22) PCT Filed: Oct. 15, 2015

(86) PCT No.: PCT/US2015/055720
§ 371 (c)(1),
(2) Date: Jan. 25, 2018

(87) PCT Pub. No.: WO2017/065774
PCT Pub. Date: Apr. 20, 2017

(65) Prior Publication Data
US 2018/0244044 A1 Aug. 30, 2018

(51) Int. Cl.
*B41J 2/16* (2006.01)
*B41J 2/14* (2006.01)

(52) U.S. Cl.
CPC ..... *B41J 2/1637* (2013.01); *B41J 2/14* (2013.01); *B41J 2/16* (2013.01); *B41J 2202/22* (2013.01)

(58) Field of Classification Search
CPC ..... B41J 2/1632; B41J 2/14; B41J 2/16; B41J 2202/22
See application file for complete search history.

(56) References Cited

U.S. PATENT DOCUMENTS

| | | | |
|---|---|---|---|
| 5,812,158 | A | 9/1998 | Murthy et al. |
| 8,132,892 | B2 | 3/2012 | Nystrom |
| 8,562,110 | B2 | 10/2013 | Zhao |
| 2011/0157278 | A1 | 6/2011 | Gulvin et al. |
| 2013/0027471 | A1 | 1/2013 | Rivas et al. |
| 2015/0091217 | A1 | 4/2015 | Araki |

FOREIGN PATENT DOCUMENTS

| | | |
|---|---|---|
| EP | 0882593 | 12/1998 |
| WO | 2009089565 | 7/2009 |
| WO | WO2009089565 A1 | 7/2009 |
| WO | WO-2015116059 | 8/2016 |

OTHER PUBLICATIONS

Kwon; Impact and Wetting Behaviors of Impinging Microdroplets on Superhydrophobic Textured Surfaces; Apr. 24, 2012; http://scitation.aip.org/content/aip/journal/apl/100/17/1 http://scitation.aip.org/content/aip/journal/apl/100/17/1063/1.4705296.

*Primary Examiner* — Sharon A. Polk
(74) *Attorney, Agent, or Firm* — HP Inc. Patent Department

(57) ABSTRACT

In example implementations, an apparatus with an embedded service structure is provided. The apparatus may include an epoxy molded compound (EMC). At least one print head die may be embedded in the EMC. A service structure may be located within the EMC adjacent to the at least one print head die.

20 Claims, 6 Drawing Sheets

SERVICE STRUCTURES IN PRINT HEADS

BACKGROUND

Ink jet printers use print heads that emit different colors of ink onto a medium in a desired pattern. Over time, the functionality of the print heads can be reduced due to contamination of ink, particles, paper stands, other debris, or other defects. As a result, print heads are serviced to ensure nozzle health.

DETAILED DESCRIPTION

The present disclosure discloses print heads having embedded service structures. As discussed above, ink jet printers use print heads that emit different colors of ink onto a medium in a desired pattern. Over time, the functionality of the print heads can be reduced due to contamination of ink, particles, paper stands, other debris, or other defects. As a result, print heads are serviced to ensure nozzle health.

Examples of the present disclosure provide embedded service structures that help minimize the amount of contamination in the print heads. The embedded service structures can create frictional anisotropy that can be used to create a wipe direction and a non-wipe direction. The embedded service structures may also collect ink or debris instead of a nozzle region so the print heads may be cleaned or serviced more efficiently. As a result, operational efficiency of the print heads can be improved by reducing the amount of down time for maintenance and improving the operational life span of the print heads.

Figure 1:
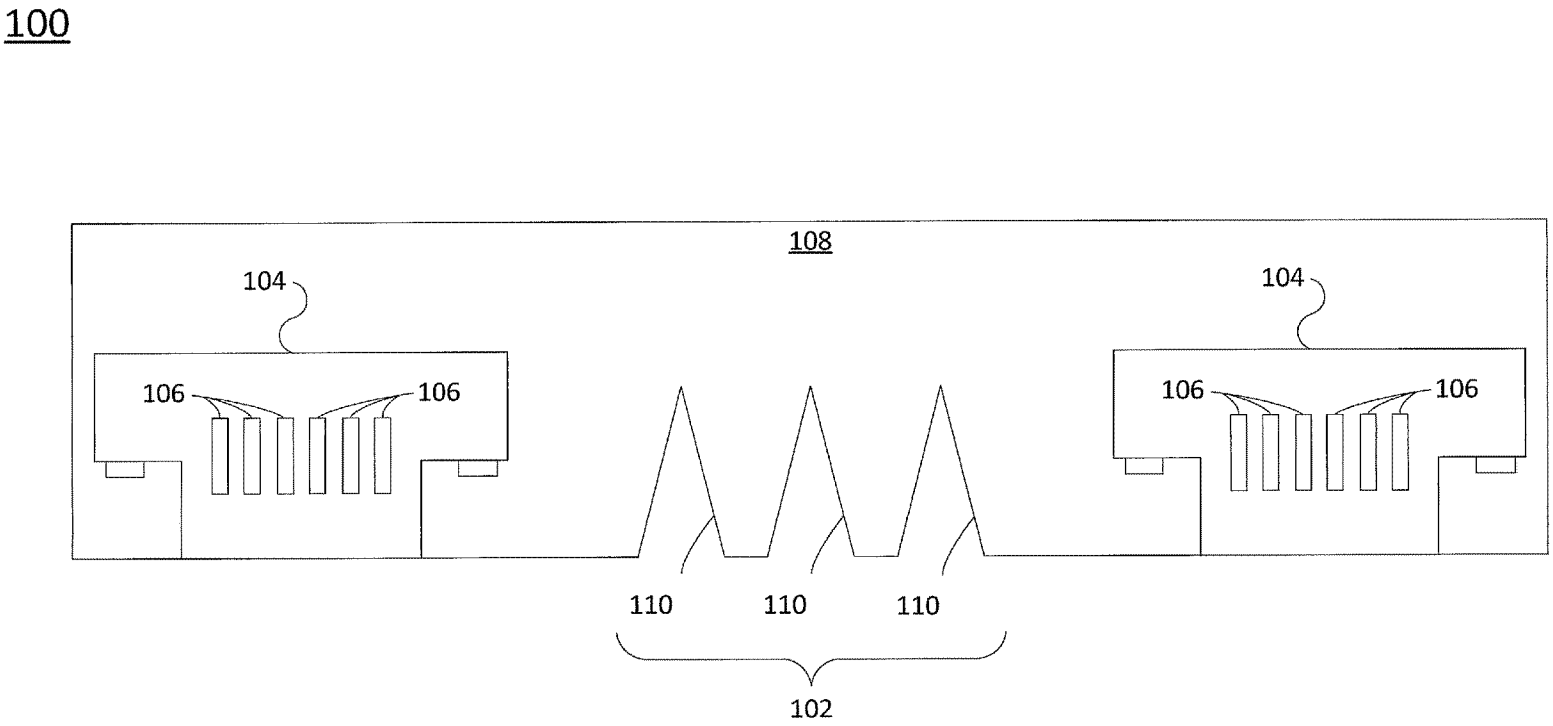
FIG. 1 is a block diagram of an example molded print head with an embedded service structure comprising a texture.

FIG. 1 illustrates an example molded print head 100 with an embedded service structure 102 of the present disclosure. The molded print head 100 includes at least one print head die 104 and the embedded service structure 102. In one example, the print head die 104 may be a thermal ink jet print head die having a plurality of nozzles 106. FIG. 1 illustrates a cross-sectional view of the print head die 104.

In one implementation, the print head die 104 may be embedded in a mold 108. The mold 108 may be an epoxy mold compound (EMC). An example EMC may include compounds such as CEL400ZHF40WG from Hitachi® Chemical. In one example, the molded print head 100 may include a plurality of print head dies 104.

In one example, the embedded service structure 102 may have a texture 110 created in the mold 108. The texture 110 may include grooves or openings. In one implementation, the grooves or openings may be created by nano-structures.

In another implementation, the texture 110 may include ridges. For example, a series of ridges may be used to create frictional anisotropy which can create a wiping direction and a non-wiping direction.

In one implementation, the embedded service structure 102 may be located adjacent to at least one print head die 104. The embedded service structure 102 may be located close to the at least one print head die 104. Close may be defined as being within 1 millimeter (mm) or less of the at least one print head die 104. In one example, the embedded service structure 102 may be located between two print head dies 104.

It should be noted that the shape of the texture 110 is provided as an example and that the texture 110 embedded in the mold 108 may have a variety of different shapes. In addition, it should be noted that the number of textures 110 is provided as an example and that any number of textures 110 may be embedded in the mold 108.

It should also be noted that although only a single embedded service structure 102 is illustrated in FIG. 1, that the molded print head 100 may include a plurality of embedded service structures 102. For example, an embedded service structure 102 may be adjacent to each one of a plurality print head dies 104 or between each pair of the plurality of print head dies 104.

Figure 2:
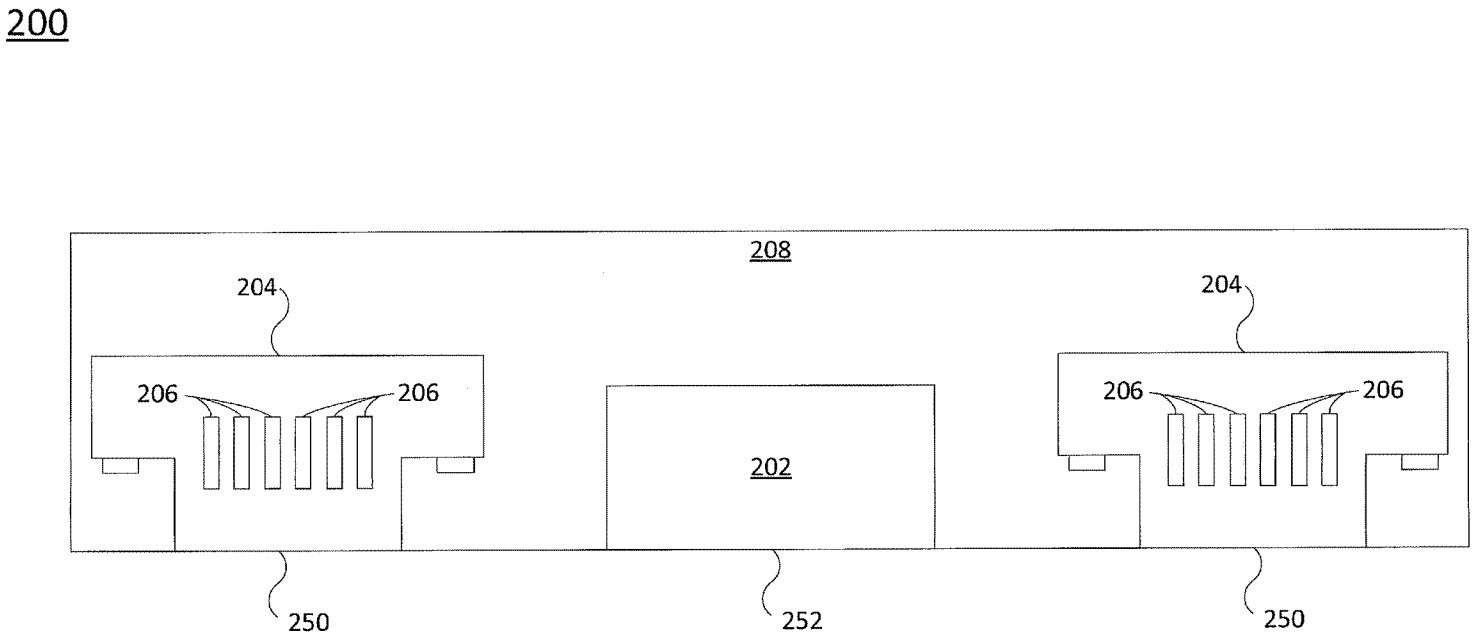
FIG. 2 is block diagram of an example molded print head with an embedded service structure comprising an embedded service material.

FIG. 2 illustrates an example molded print head 200 with an embedded service structure 202 of the present disclosure. The molded print head 200 includes at least one print head die 204 and the embedded service structure 202. In one example, the print head die 204 may be a thermal ink jet print head die having a plurality of nozzles 206. FIG. 2 illustrates a cross-sectional view of the print head die 204.

In one implementation, the print head die 204 may be embedded in a mold 208. The mold 208 may be an epoxy mold compound (EMC). An example EMC may include compounds such as CEL400ZHF40WG from Hitachi® Chemical. In one example, the molded print head 200 may include a plurality of print head dies 204.

In one example, the embedded service structure 202 may be an embedded service material having a low surface energy. For example, the embedded service material may include materials such as a polyhexafluoroethylene, a polytetrafluoroethylene (PTFE), a poly(vinylidene fluoride) (PVF), a poly(chlorotrifluoroethylene), a polyethylene (PE), a polypropylene (PP), or a silica filler with a low surface energy coating in an epoxy matrix.

In one example, the embedded service structure 202 may be co-planar with the print head dies 204. In other words, at least one surface of the print head dies 204 and the embedded service structure 202 share, or lie, on a common plane. As illustrated in FIG. 2, a surface 250 of the print head dies 204 and a surface 252 of the embedded service structure 202 are co-planar.

In one implementation, the embedded service structure 202 may be located adjacent to at least one print head die 204. The embedded service structure 202 may be located close to the at least one print head die 204. Close may be defined as being within 1 millimeter (mm) or less of the at least one print head die 204. In one example, the embedded service structure 202 may be located between two print head dies 204.

It should be noted that the shape of the embedded service structure 202 is provided as an example and that the embedded service structure 202 embedded in the mold 208 may have a variety of different shapes. It should also be noted that although only a single embedded service structure 202 is illustrated in FIG. 1, that the molded print head 200 may include a plurality of embedded service structures 202. For example, an embedded service structure 202 may be adjacent to each one of a plurality print head dies 204 or between each pair of the plurality of print head dies 204.

Figure 3:
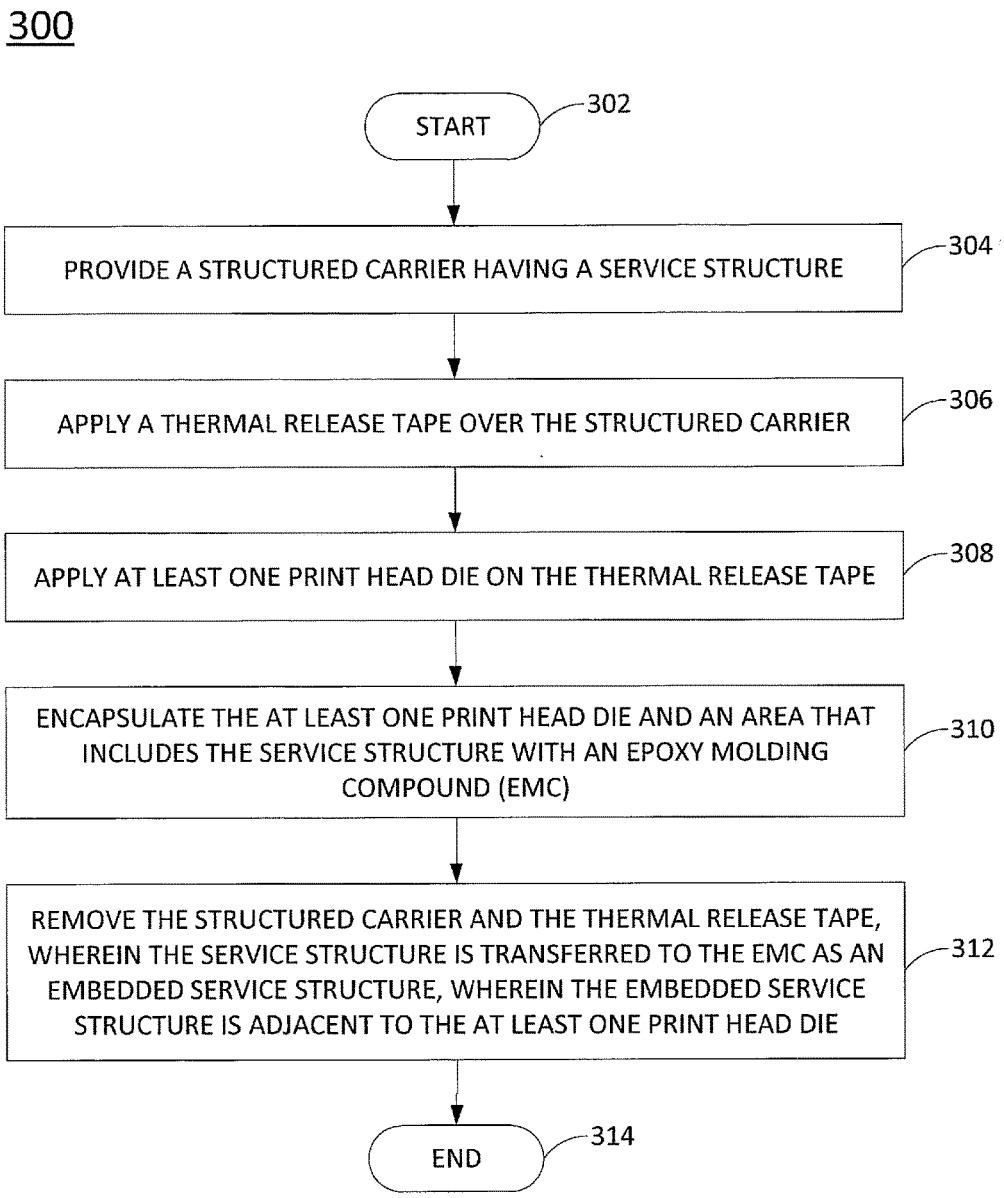
FIG. 3 is a flow diagram of an example method for manufacturing the molded print head with a texture.

FIG. 3 illustrates a flow diagram of an example method 300 for manufacturing a molded print head with a texture. The method 300 may be performed by various tools or machines within a fabrication plant. FIG. 3 may be read in conjunction with FIG. 4 that illustrates a schematic flow diagram 400 of the example method 300.

At block 302, the method 300 begins. At block 304, the method 300 provides a structured carrier having a service structure. The structured carrier may be a printed circuit board (PCB) (e.g., an FR4 PCB). The service structure may be fabricated to include the service structures that are used to create the embedded service structures in the molded print head.

At block 306, the method 300 applies a thermal release tape over the structured carrier. The thermal release tape may be any type of material that allows for adhesion of electrical components at room temperature and removal via heating of the thermal release tape. The thermal release tape may be used to remove the structured carrier from the molded print head. An example of the thermal release tape that can be used may be product number 3195V from Nitto Denko®.

At block 308, the method 300 applies at least one print head die on the release tape. In one example, a plurality of print head dies may be applied to the release tape.

The schematic flow diagram 400 illustrates an example structured carrier 410, the thermal release tape 412 and the print head dies 104 in block 402 after the blocks 304, 306 and 308 are completed. As illustrated in block 402, the structured carrier includes service structures 450 that are transferred and embedded into a mold, as discussed below.

Referring back to FIG. 3, at block 310, the method 300 encapsulates the at least one print head die and an area that includes the service structure with an epoxy molding compound (EMC). As shown in block 404 of FIG. 4, an area 452 may include the service structures 450 that are used to form the embedded service structures in the molded print head. The area 452 and the print head dies 104 may be encapsulated by the mold 108.

In one example, the mold 108 may be applied using a compression mold tool. In one example, the compression mold tool may be from TOWA®. The mold 108 may be applied at 140 degrees Celsius (° C.) for approximately 5 minutes.

Referring back to FIG. 3, at block 312, the method 300 removes the structured carrier and the thermal release tape, wherein the service structure is transferred to the EMC as an embedded service structure, wherein the embedded service structure is adjacent to the at least one print head die. In one example, adjacent may be defined as being within 1 mm or less of the at least one print head die.

In one example, the embedded service structure may correspond to a shape and number of service structures formed on the structured carrier. The embedded service structure may capture ink and debris instead of a nozzle area so the print head can be serviced easily.

Figure 4:
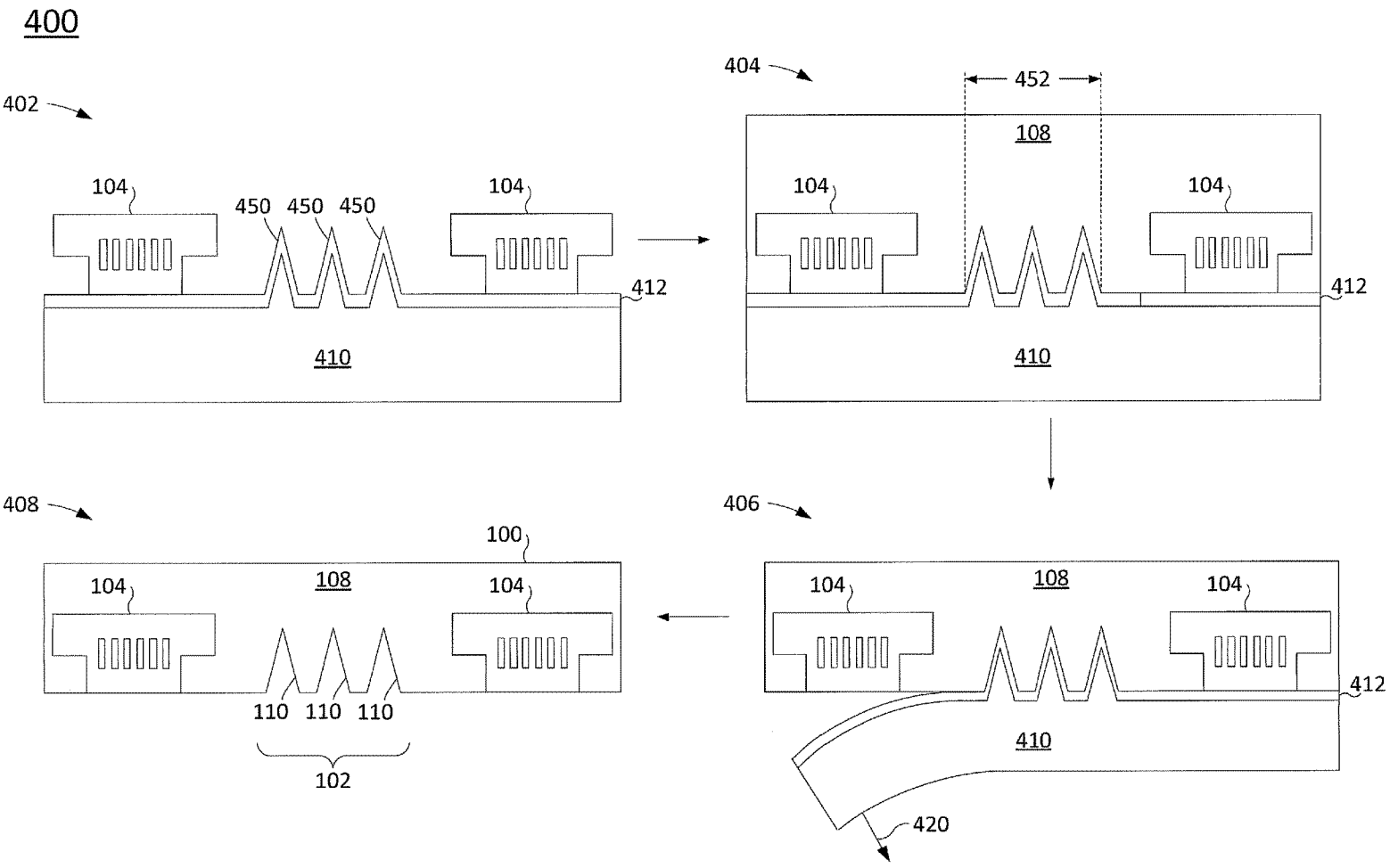
FIG. 4 is a schematic flow diagram of an example method for manufacturing the molded print head with a texture.

In FIG. 4 at block 406, the thermal release tape 412 is pulled away from the mold 108, as shown by the arrow 420. In other words, the molded print head is released from the thermal release tape 412.

At block 408, the manufacturing of molded print head 100 is completed. For example, the molded print head 100 may be cured after being released from the thermal release tape 412. In one example, the molded print head 100 may be cured for approximately one hour at 150° C. Referring back to FIG. 3, the method 300 ends at block 314.

Figure 5:
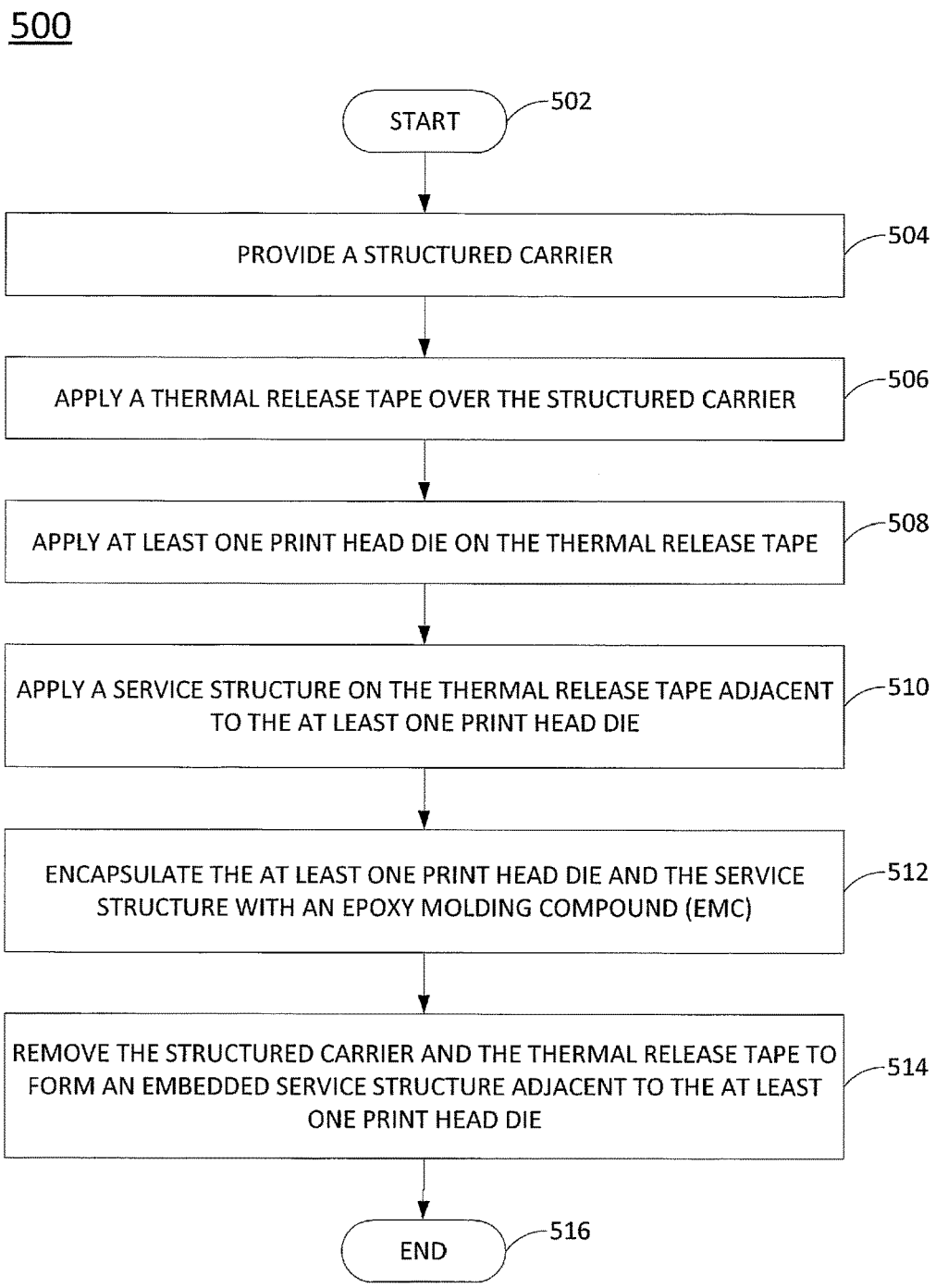
FIG. 5 is a flow diagram of an example method for manufacturing the molded print head with an embedded service material.

FIG. 5 illustrates a flow diagram of an example method 500 for manufacturing a molded print head with an embedded service material. The method 500 may be performed by various tools or machines within a fabrication plant. FIG. 5 may be read in conjunction with FIG. 6 that illustrates a schematic flow diagram 600 of the example method 500.

At block 502, the method 500 begins. At block 504, the method 500 provides a structured carrier. The structured carrier may be a printed circuit board (PCB) (e.g., an FR4 PCB).

At block 506, the method 500 applies a thermal release tape over the structured carrier. The thermal release tape may be any type of material that allows for adhesion of electrical components and removal via heating of the thermal release tape. The thermal release tape may be used to remove the structured carrier from the molded print head. An example of the thermal release tape that can be used may be product number 3195V from Nitto Denko®.

At block 508, the method 500 applies at least one print head die on the release tape. In one example, a plurality of print head dies may be applied to the release tape.

Figure 6:
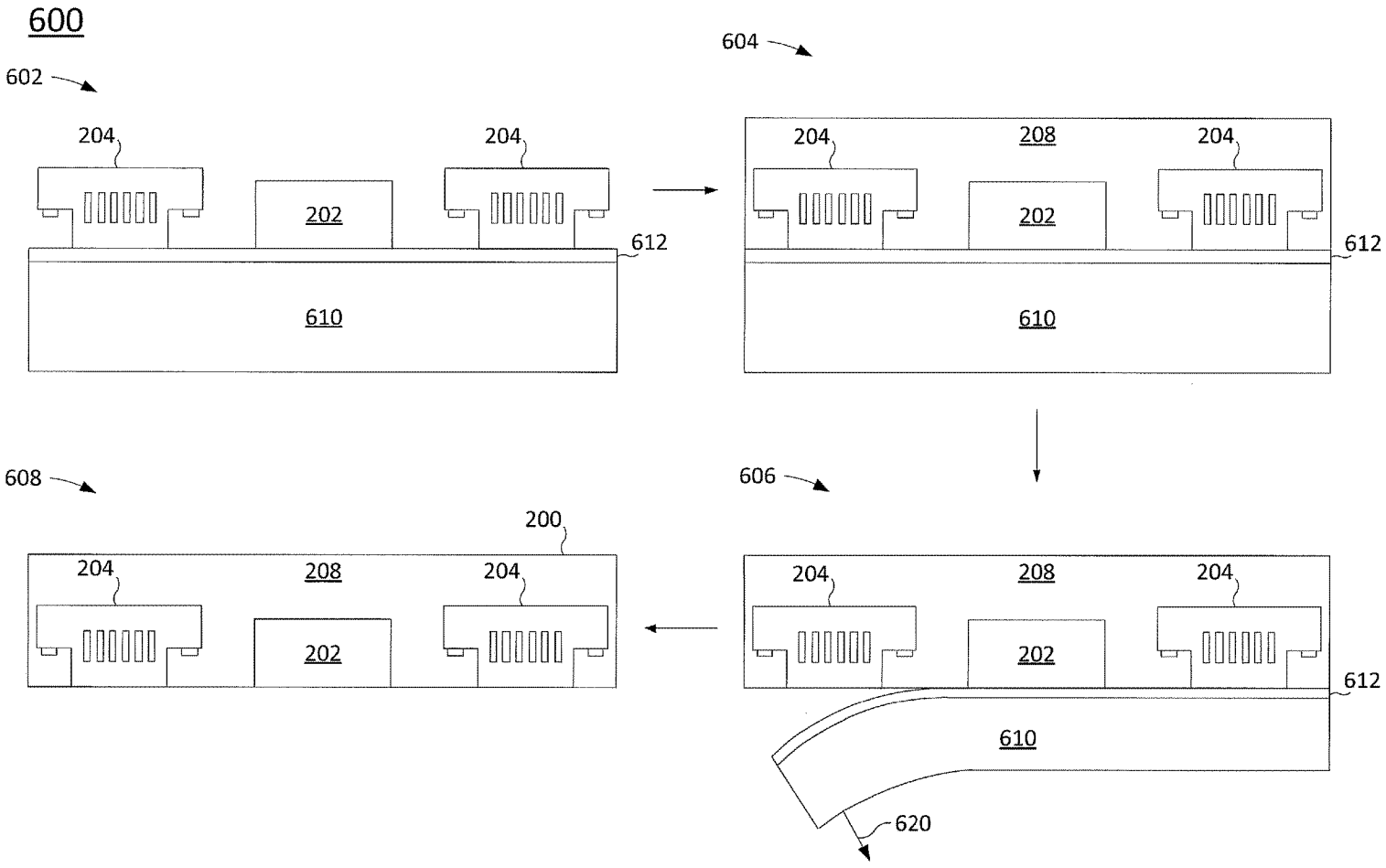
FIG. 6 is a schematic flow diagram of an example method for manufacturing the molded print head with the embedded service material.

At block 510, the method 500 applies a service structure on the thermal release tape adjacent to the at least one print head die. In one example, the service structure may be a material with a low surface energy. As described above, a low surface energy surface has a tendency to not wet as easily as a high surface energy. As a result, ink and debris may not accumulate as easily on the low surface energy surface created by the embedded service structure. For example, the embedded service material may include materials such as a polyhexafluoroethylene, a polytetrafluoroethylene (PTFE), a poly(vinylidene fluoride) (PVF), a poly (chlorotrifluoroethylene), a polyethylene (PE), a polypropylene (PP), or a silica filler with a low surface energy coating in an epoxy matrix. The schematic flow diagram 600 in FIG. 6 illustrates an example structured carrier 610, the thermal release tape 612, the print head dies 204 and the service structure 202 in block 602 after the blocks 504, 506, 508 and 510 are completed.

Referring back to FIG. 5, at block 512, the method 500 encapsulates the at least one print head die and the service structure with an epoxy molding compound (EMC). As shown in block 604 of FIG. 6, the print head dies 204 and the service structure 202 may be encapsulated by the mold 208.

In one example, the mold 208 may be applied using a compression mold tool. In one example, the compression mold tool may be from TOWA®. The mold 208 may be applied at 140 degrees Celsius (° C.) for approximately 5 minutes.

Referring back to FIG. 5, at block 514, the method 500 removes the structured carrier and the thermal release tape to form an embedded service structure adjacent to the at least one print head die. In one example, adjacent may be defined as being within 1 mm or less of the at least one print head die.

In one example, the embedded service structure and the at least one print head die may be co-planar. In other words, at least one surface of the print head die and the embedded service structure share, or lie, on a common plane.

In FIG. 6 at block 606, the thermal release tape 612 is pulled away from the mold 208, as shown by the arrow 620. In other words, the molded print head is released from the thermal release tape 612.

At block 608, the manufacturing of molded print head 200 is completed. For example, the molded print head 200 may be cured after being released from the thermal release tape 612. In one example, the molded print head 200 may be cured for approximately one hour at 150° C. Referring back to FIG. 5, the method 500 ends at block 516.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. An apparatus, comprising:

an epoxy molded compound (EMC);

at least one print head die embedded in the EMC; and a service structure within the EMC located adjacent to the at least one print head die.

2. The apparatus of claim 1, wherein the service structure comprises a texture formed in the material of the EMC.

3. The apparatus of claim 2, wherein the texture comprises a plurality of nano-structures.

4. The apparatus of claim 2, wherein the texture comprises a plurality of ridges.

5. The apparatus of claim 1, wherein the service structure comprises an embedded service material having a low surface energy.

6. The apparatus of claim 5, wherein the embedded service material is co-planer with the at least one print head die.

7. The apparatus of claim 5, wherein the embedded service material comprises at least one of: a polyhexafluoroethylene, a polytetrafluoroethylene (PTFE), a poly(vinylidene fluoride) (PVF), a poly(chlorotrifluoroethylene), a polyethylene (PE), a polypropylene (PP), or a silica filler with a low surface energy coating in an epoxy matrix.

8. The apparatus of claim 1, wherein the service structure is located within 1 millimeter or less to the at least one print head die.

9. The apparatus of claim 1, wherein the service structure is spaced apart from the at least one print head die by 1 millimeter or less.

10. The apparatus of claim 1, comprising two print head dies, the service structure being located between the two print head dies.

11. The apparatus of claim 1, wherein the service structure comprises a separate structure that is embedded in the EMC.

12. A method, comprising:

providing a structured carrier having a service structure;

applying a thermal release tape over the structured carrier;

applying at least one print head die on the thermal release tape;

encapsulating the at least one print head die and an area that includes the service structure with an epoxy molding compound (EMC); and removing the structured carrier and the thermal release tape, wherein the service structure is transferred to the EMC as an embedded service structure, wherein the embedded service structure is adjacent to the at least one print head die.

13. The method of claim 12, wherein the embedded service structure comprises a texture.

14. The method of claim 13, wherein the texture comprises a plurality of nano-structures.

15. The method of claim 13, wherein the texture comprises a plurality of ridges.

16. A method, comprising: providing a structured carrier;

applying a thermal release tape over the structured carrier;

applying at least one print head die on the thermal release tape;

applying a service structure on the thermal release tape adjacent to the at least one print head die;

encapsulating the at least one print head die and the service structure with an epoxy molding compound (EMC); and removing the structured carrier and the thermal release tape to form an embedded service structure adjacent to the at least one print head die.

17. The method of claim 16, wherein the embedded service structure comprises an embedded service material.

18. The method of claim 17, wherein the embedded service material comprises at least one of: a polyhexafluoroethylene, a polytetrafluoroethylene (PTFE), a poly(vinylidene fluoride) (PVF), a poly(chlorotrifluoroethylene), a polyethylene (PE), a polypropylene (PP), or a silica filler with a low surface energy coating in an epoxy matrix.

19. The method of claim 16, wherein the service structure is spaced apart from the at least one print head die by 1 millimeter or less.

20. The method of claim 16, further comprising applying two print head dies, the service structure being located between the two print head dies.

* * * * *